US005685816A

United States Patent [19]

Romer

[11] Patent Number: 5,685,816

[45] Date of Patent: Nov. 11, 1997

[54] ENVELOPE MAKER AND METHOD OF USE

[76] Inventor: Nicholas K. Romer, 1002 E. Markham Ct., Bel Air, Md. 21014

[21] Appl. No.: 633,653

[22] Filed: Apr. 17, 1996

Related U.S. Application Data

[63] Continuation-in-part of Ser. No. 339,885, Nov. 14, 1994, Pat. No. 5,518,491.

[51] Int. Cl.[6] ..... B31B 1/26

[52] U.S. Cl. ..... 493/231; 493/252; 493/468

[58] Field of Search ..... 493/231, 243, 493/245, 250, 251, 252, 253, 405, 453, 468, 916, 917; 33/562, 563

[56] References Cited

U.S. PATENT DOCUMENTS

| | | | |
|---|---|---|---|
| 13,647 | 10/1855 | Goodale | 493/231 |
| 14,643 | 4/1856 | Low | 493/231 |
| 64,537 | 5/1867 | Jaeger | 493/253 |
| 138,028 | 4/1873 | Keating | 493/250 |
| 207,288 | 8/1878 | Laverty | 493/916 |
| 313,197 | 3/1885 | Gaylord | 33/562 |
| 340,246 | 4/1886 | Richards | 493/252 |
| 401,718 | 4/1889 | Richards | 493/252 |
| 453,436 | 6/1891 | Bouvier | 493/250 |
| 659,960 | 10/1900 | Ermold | 493/917 |
| 980,539 | 1/1911 | Lester | 493/917 |
| 1,441,440 | 1/1923 | Mackness | 33/562 |
| 1,879,624 | 9/1932 | Lockwood | 33/563 |
| 1,941,412 | 12/1933 | Nichols | 493/917 |
| 2,155,656 | 4/1939 | Hayes | 493/243 |
| 2,718,028 | 9/1955 | Buda et al. | 493/917 |
| 3,786,586 | 1/1974 | Swan | 33/563 |
| 4,274,459 | 6/1981 | Galadja | 33/563 |
| 5,253,427 | 10/1993 | Bartlett | 33/563 |
| 5,347,724 | 9/1994 | Hankins | 33/563 |
| 5,378,222 | 1/1995 | Weber | 493/405 |
| 5,518,491 | 5/1996 | Romer et al. | 493/231 |
| 5,577,328 | 11/1996 | Kerry, Sr. | 33/563 |

*Primary Examiner*—Joseph J. Hail, III
*Assistant Examiner*—Darren Ark
*Attorney, Agent, or Firm*—Henderson & Sturm

[57] ABSTRACT

An improved envelope maker (10) including: a template member (20) having first (28) and second (29) indicia markings and a cutout (22); a primary center piece member (40) dimensioned to be received in the cutout (22); and; an auxiliary center piece member (50) provided with means for operatively engaging the primary center piece member (40); wherein the envelope maker can be employed to make a variety of envelopes having the finished dimensions of the primary center piece member (40), the auxiliary center piece member (50) and larger.

11 Claims, 4 Drawing Sheets

ENVELOPE MAKER AND METHOD OF USE

This is a continuation in part application of application Ser. No. 08/339,885 filed on Nov. 14, 1994 and entitled "Envelope Maker and Method of Using", now U.S. Pat. No. 5,518,491 the contents of which are incorporated herein by reference.

TECHNICAL FIELD

This invention relates in general to an apparatus for making envelopes and a method of using the apparatus, and in particular to an improved apparatus that can be used to produce a variety of different sized envelopes.

BACKGROUND OF THE INVENTION

In the prior art, envelopes have been made using various types of apparatus, however, the apparatus have all been either the type used to make many envelopes at one time, or complicated and time consuming apparatus to make envelopes one at a time.

SUMMARY OF THE INVENTION

This invention relates to an improved apparatus for making envelopes of different sizes. The invention comprises: a template, a primary center piece and an auxiliary center piece. The template is used to establish the tear lines and the dimensions of the material used to make the different sized envelopes. It has a central cut out portion to correctly position both the primary and auxiliary center pieces which are used as a guide to fold the material into different sized envelopes.

This invention is economical to produce and simple enough to use that even a child can easily produce perfect envelopes every time.

It is an object of this invention to produce a simple to use envelope maker that can be used by anyone to make a variety of different sized perfect envelopes every time.

It is an object of this invention to produce an improved envelope maker that is inexpensive to produce.

It is an object of this invention to produce an envelope maker that can be used to make different sized envelopes from virtually any type of material.

It is an object of this invention to produce an envelope maker that can use recyclable material as the raw material in producing envelopes.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
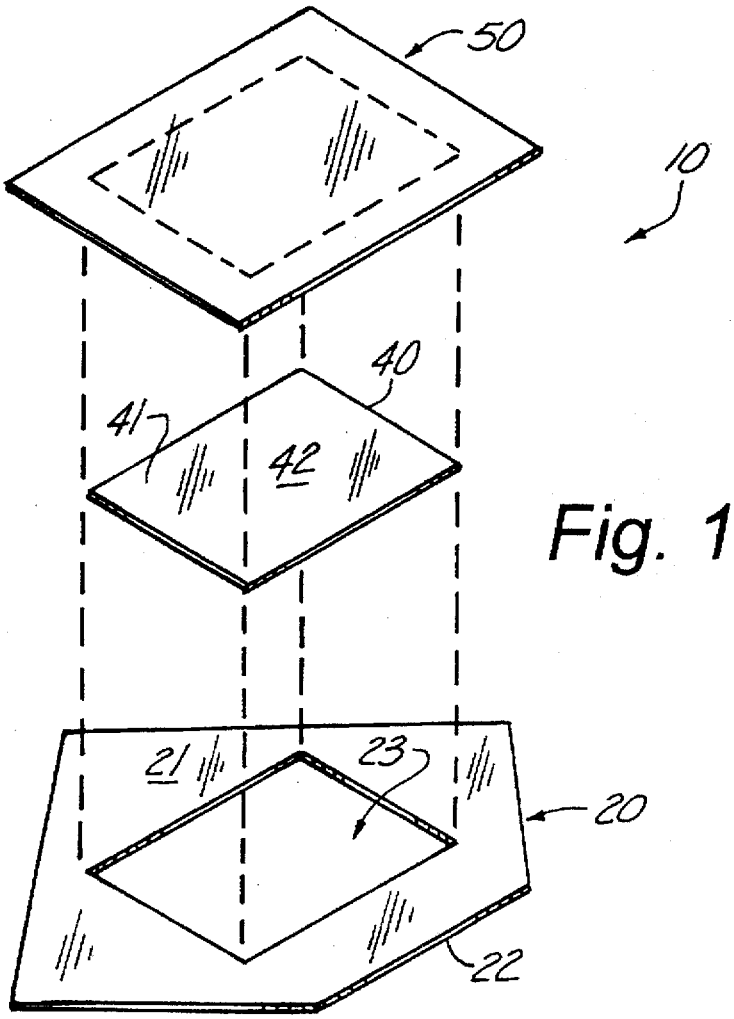
FIG. 1 is an exploded perspective view of the major components that form the basis of the present invention.

As can be seen by reference to the drawings, and in particular to FIG. 1, the improved envelope maker that forms the basis of the present invention is designated generally by the reference numeral (10). The envelope maker (10) comprises in general a template member (20), a primary center piece member (40) and an auxiliary center piece member (50). These members will now be described in seriatim fashion.

Figure 5:
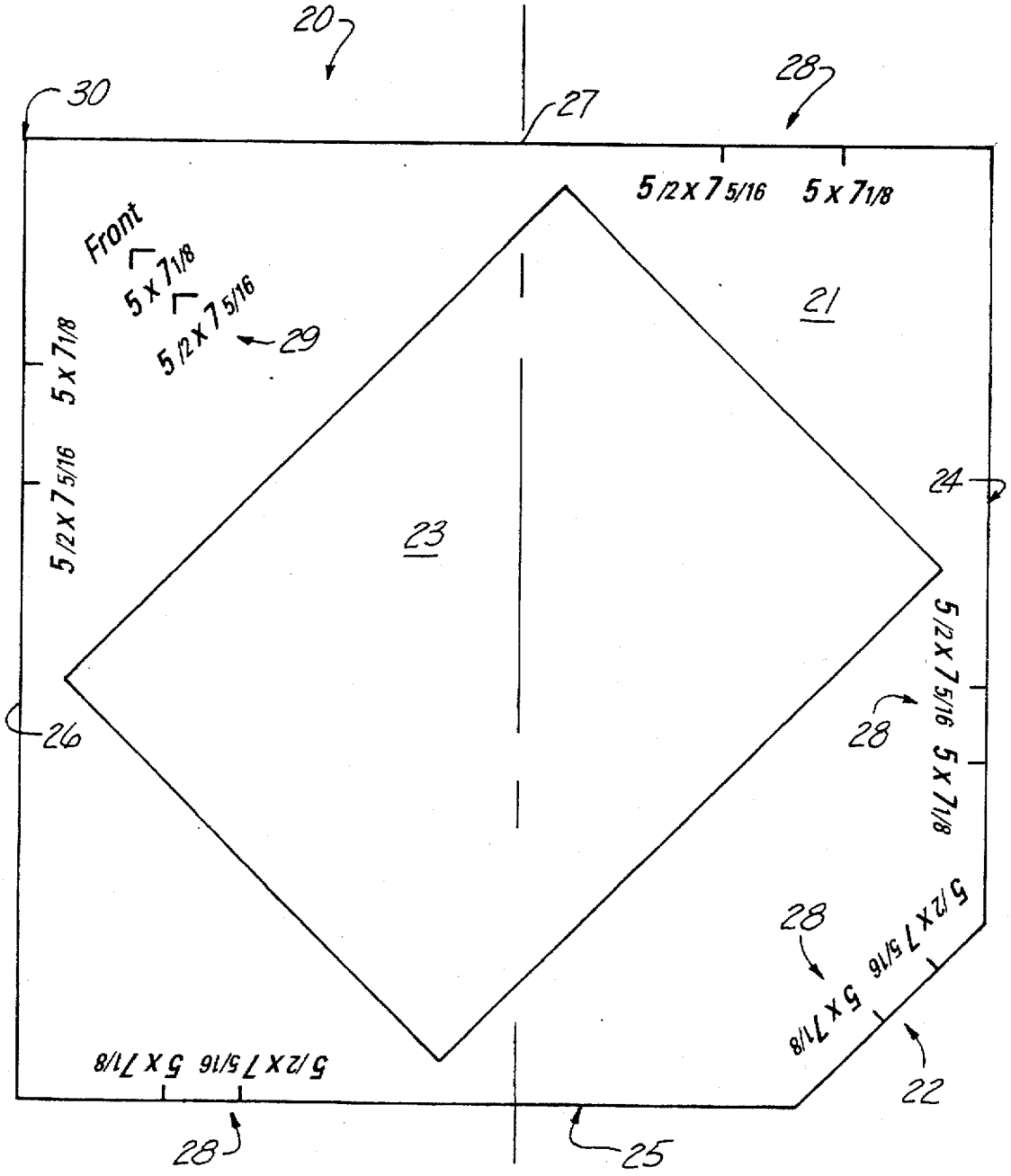
FIG. 5 is a top plan view of the template.

As shown in FIGS. 1 and 5, the template member (20) comprises a generally thin flat square piece of transparent material (21) such as plastic, or the like; wherein one of the corners has been removed to form a relatively short straight edged section (22). In addition the template member (20) is also provided with a generally rectangular cutout (23) which is disposed at an angle to the vertical axis of the template member (20).

As can best be seen by reference to FIG. 5, the relatively short straight edged section (22) forms two adjacent shortened sides (24) and (25) which are disposed opposite two full length sides (26) and (27) which form the periphery of the generally square template member (20).

Still referring to FIG. 5, it can be seen that first indicia markings (28) are provided adjacent to but spaced from the outboard ends (as viewed in a clockwise direction) of each of the sides (25), (26), (27), and (24) of the template; and, identical indicia markings (28) are generally evenly spaced from the opposite ends of the relatively short straight edged section (22).

In addition, second indicia markings (29) are spaced from the corner (30) of the template member (20) which is diametrically opposed to the relatively short straight edged section (22); wherein, the first indicia markings (28) comprise straight slash marks disposed perpendicular to the respective edges of the template member (20); and, the second indicia marking (29) comprise V-shaped marks disposed generally parallel to the corner (30) of the template member (20).

Furthermore, both the first (28) and second (29) indicia markings include numerical indicia representative of given envelope sizes; the second indicia markings (29) also include the legend FRONT; and, the purpose and function of these indicia markings (28) (29) will be explained further on in the specification.

Turning now to FIGS. 1 through 4, it can be seen that the primary center piece member (40) comprises a generally rectangular thin sheet (41) of material (42) which is dimensioned to be received within the rectangular cutout (23) in the template member (20) to fabricate an envelope having the finished dimensions of the primary center piece member (40) in accordance with the teachings contained in my co-pending patent application.

As can be seen by reference to FIGS. 1 through 4, the auxiliary center piece member (50) comprises an enlarged generally rectangular sheet (51) of material which is dimensioned to overlie, project beyond and cooperate with the primary center piece member (40) as will be explained presently.

Figure 2:
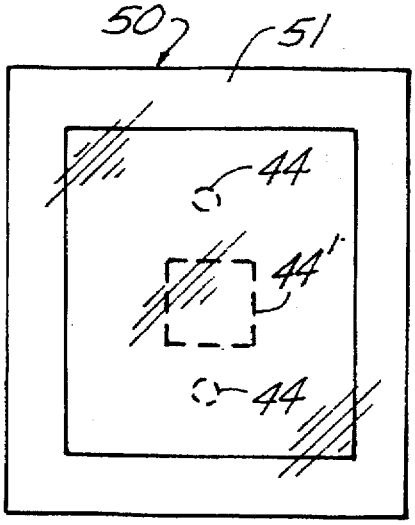
FIG. 2 is a top plan view of the primary center piece and the auxiliary center piece.
Figure 3:
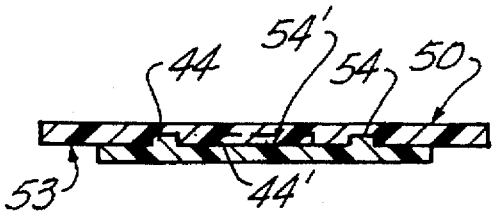
FIG. 3 is a cross-sectional view showing one version of the operative engagement between the primary and auxiliary center pieces.
Figure 4:
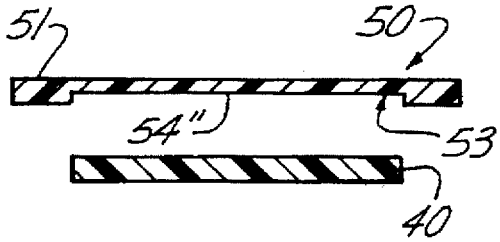
FIG. 4 is a cross-sectional view showing another version of the operative engagement between the primary and auxiliary center pieces.

Referring to FIGS. 2 through 4, it can be seen that the center piece member (40) is designed and intended to be centrally disposed and operatively engaged relative to the bottom surface (53) of the auxiliary center piece member (50).

As shown in FIGS. 2 and 3, this operative engagement between the primary (40) and auxiliary (50) center piece members may be accomplished by providing one of the centerpiece members (40) with one or more projections (44) and the other center piece member (50) with a complimentary recess (54) to captively engage the center piece members (40) and (50) together.

In the versions illustrated in FIGS. 2 and 3, the projections (44) may comprise a plurality, of short cylindrical posts which fit into a plurality of shallow cylindrical recesses or apertures (54) or a single rectangular projection (44') depicted in phantom that is received in a complimentary rectangular recess or aperture (54') likewise depicted in phantom.

In another version illustrated in FIG. 4, the bottom surface (53) of the auxiliary center piece member (50) is provided with an enlarged rectangular shallow recess (54") which is dimensioned to releasably engage the outer periphery of the primary center piece member (40).

As was mentioned previously, the cooperation between the template member (20) and the primary center piece member (40) to practice a method of making envelopes has been previously set forth in my above mentioned co-pending application. However, the new indicia markings (28) and (29) on the template member (20) as well as the cooperative engagement between the primary (40) and auxiliary (50) center piece members allows additional envelopes having the finished dimensions of not only the auxiliary center piece member (50) but even larger dimensioned envelopes to be fabricated in accordance with the teachings of this invention.

In order to fabricate the larger envelopes, the primary (40) and auxiliary (50) center piece members are operatively engaged with one another, and then the primary center piece member (40) is inserted into the cutout (23) in the template member (20). The auxiliary center piece member (50) is then selectively positioned on a decorative sheet of paper designated generally as (100) to dispose the template member (20) in the desired orientation relative to the decorative sheet of paper (100) prior to the severing step.

Figure 6:
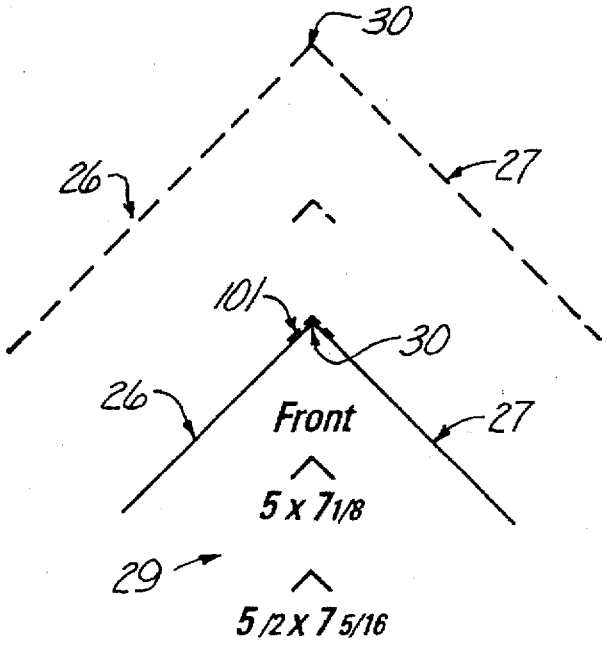
FIG. 6 illustrates the steps employed in the formation of the closure flap of the finished envelope.

As shown in FIG. 6, once the template member (20) is positioned at the desired location, a V-shaped mark (101) is made on the decorative paper (100) at the corner (30) of the template member (20). The transparent template member (20) is then shifted along the decorative paper to align a chosen one of the second indicia markings (29) with the V-shaped mark (101) on the paper (100).

Figure 7:
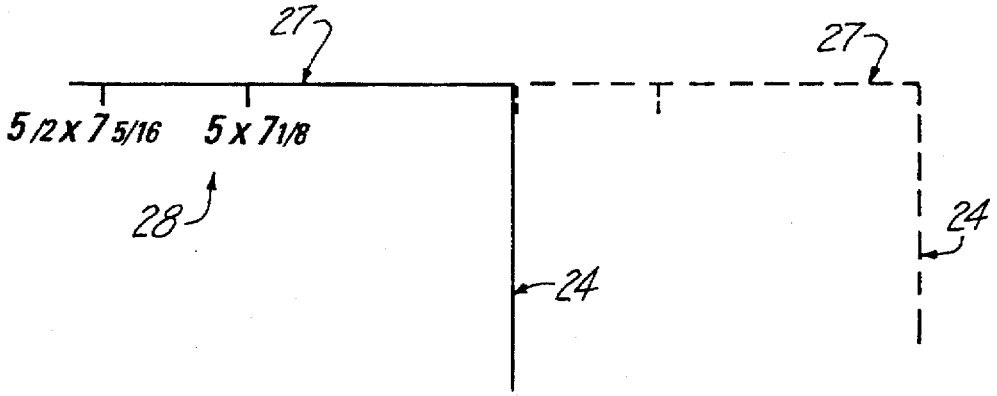
FIG. 7 illustrates the steps employed in the formation of one of the corners of the severed material that is used to fabricate the envelope.

At this juncture, the severing or cutting step commences from the corner (30) and along one side (27) of the template member (20) as shown in FIG. 7. Once the paper (100) has been cut to the far end of side (27), the template member (20) is shifted laterally to align the initial terminus of the cut with an indicia marking (28) on the side (27) which coincides with the previously selected indicia marking (29). The cutting of the paper (100) then continues to the shifted end of the side (27); whereupon, the direction of the cut is changed and continued along side (24). The cut along side (24) then proceeds in accordance with the two phase cutting steps of side (27).

Figure 8:
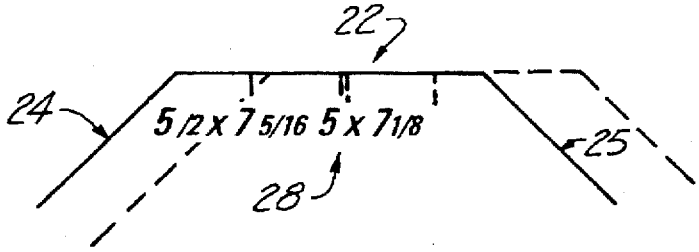
FIG. 8 illustrates the steps employed in the formation of the lower back flap of the finished envelope.

As shown in FIG. 8, when the cut has ended along side (24), the direction of the cut is once more changed and continued along the short straight edged section (22) going through the initial cut, lateral shift, and final cutting phases. This process then continues along sides (25) and (26) until the decorative paper (100) has been completely severed around the periphery of the template member (20).

Figure 9:
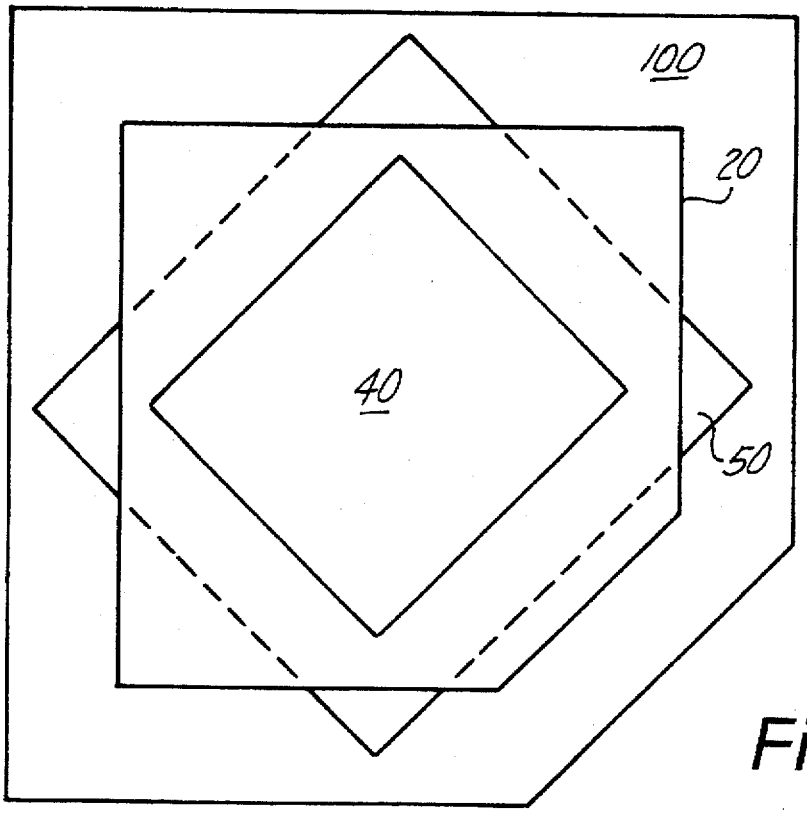
FIG. 9 is a top plan view of the apparatus disposed on the backside of a severed sheet of decorative paper; and, FIG. 10 is a top plan view of the disposition of the auxiliary center piece member prior to the folding and gluing steps that produce the finished envelope.

At this juncture, as shown in FIG. 9, the decorative paper (100) is placed face down on a horizontal support surface (not shown). The envelope making apparatus (10) is then inverted so that the top surface of the auxiliary center piece member (50) is in contact with the backside of the decorative paper (100). The template member (20) is then shifted on the backside of the decorative paper until the periphery of the template member (20) is generally uniformly aligned with the severed periphery of the decorative paper (100).

Figure 10:
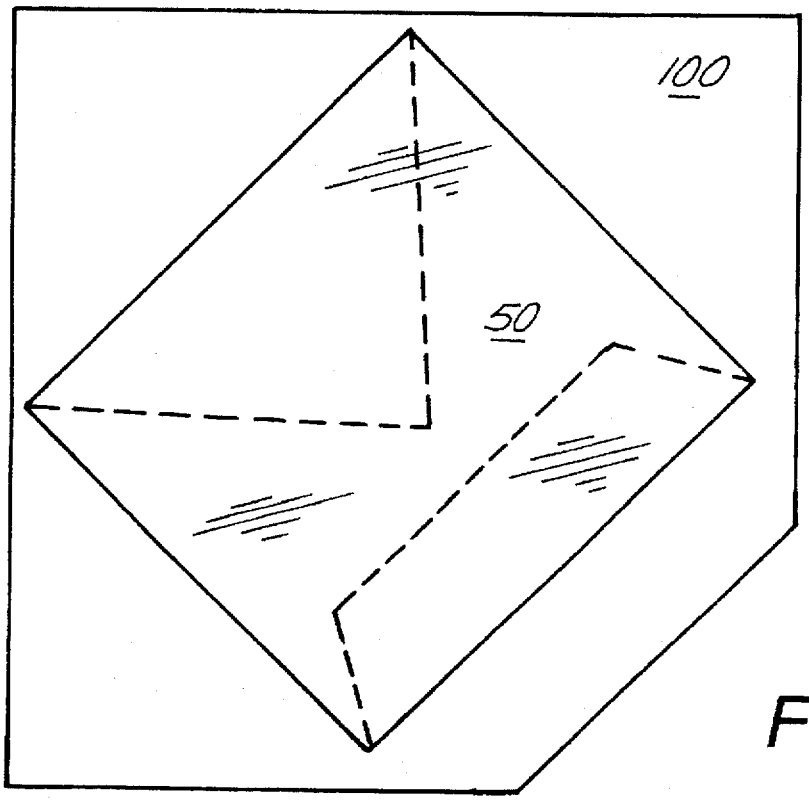

Turning now to FIG. 10, it can be seen that the template member (20) is then lifted up leaving the auxiliary center piece member (50) properly oriented with the backside of the decorative paper, whereupon the folding and gluing steps set forth in my co-pending patent application are employed to complete the fabrication of the finished envelope.

As was mentioned previously and can be readily appreciated by reference to FIG. 5, the indicia markings (28) and (29) can be employed to create finished envelopes having different dimensions; and, while the dimensions shown are 5×7⅛ and 5½×7⁵⁄₁₆, these dimensions are for illustration purposes only, and the teachings of this invention are not to be limited to that extent.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. An improved envelope maker for making an envelope from a sheet of decorative paper wherein the envelope maker comprises:

a template member formed in the shape of a square having one corner removed to produce a short straight edge having adjacent relatively short sides and full length sides disposed opposite each of said relatively short sides; wherein, the template member is further provided with a generally rectangular cutout disposed at an angle to the vertical axis of the template member;

a primary center piece member dimensioned to be received in said generally rectangular cutout; and, an auxiliary center piece member having a generally rectangular configuration and dimensioned to overlie, project beyond and be operatively engaged with said primary center piece member for the purpose of providing a means for folding the sheet of decorative paper into an envelope having a size conforming to either the primary center piece member or the auxiliary center piece member.

2. The envelope maker of claim 1; wherein, said primary center piece member is releasably connected to said auxiliary center piece member.

3. The envelope maker as in claim 2; wherein, one of the center piece members is provided with at least one recess dimensioned to receive a portion of the other center piece member.

4. The envelope maker as in claim 2; wherein, the auxiliary center piece member is provided with an enlarged recess which is dimensioned to releasably receive the periphery of the primary center piece member.

5. The envelope maker as in claim 3; wherein, the other of the center piece members has a generally rectangular projection formed thereon and the at least one recess in said one center piece member is dimensioned to releasably receive the generally rectangular projection.

6. The envelope maker as in claim 3; wherein, the other of the center piece members has a plurality of projections and the said one center piece member has a like plurality of recesses dimensioned to receive said projections.

7. The envelope maker as in claim 1; wherein, the template member is provided with first indicia markings at spaced locations around the periphery of the template member.

8. The envelope maker as in claim 7; wherein, said first indicia markings are disposed proximate to but spaced from one end of each of the relatively short and full length sides of the template member.

9. The envelope maker as in claim 8; wherein, said first indicia markings are disposed intermediate the ends of said short straight edge.

10. The envelope maker as in claim 7; wherein, the template member is further provided with second indicia markings spaced from one corner of the template member.

11. A method of making an envelope from a decorative piece of paper using a template member having: five side edges bearing first indicia markings; five corners wherein one corner has second indicia markings spaced therefrom; and, a cutout disposed therein; a primary center piece member dimensioned to be received in said cutout; and, an enlarged auxiliary center piece member dimensioned to project beyond and be operatively engaged with the primary center piece member, comprising the steps of:

a) placing the template member operatively associated with the primary and auxiliary center piece members on the face of the decorative piece of paper to selectively position the auxiliary center piece member with respect thereto;

b) making a mark on the face of the decorative piece of paper at said one corner having second indicia markings;

c) shifting said one corner to align a selected one of the second indicia markings with the mark;

d) making an initial cut in the piece of paper along a first side adjacent said one corner to the end of the first side;

e) shifting the template member along said initial cut to selectively register one of the first indicia markings on said first side with the terminus of the initial cut and continuing said initial cut to the shifted end of said first side;

f) repeating steps e) and d) for the remaining sides of the template member;

g) reversing the cut piece of paper and the template member still operatively engaged with the primary and auxiliary center piece members so that the auxiliary center piece member is in contact with the backside of the piece of paper;

h) positioning the template member so that the periphery of the template member is generally evenly spaced from the periphery of the cut piece of paper to properly position the auxiliary center piece member relative to the backside of the piece of paper;

i) removing the template member from operative engagement with the primary and auxiliary center piece members; and, j) using the auxiliary center piece member as a guide to form an envelope from the cut piece of paper.

* * * * *